US005628893A

United States Patent [19]

Opaskar

[11] Patent Number: 5,628,893

[45] Date of Patent: May 13, 1997

[54] HALOGEN TIN COMPOSITION AND ELECTROLYTIC PLATING PROCESS

[75] Inventor: Vincent C. Opaskar, Chagrin Falls, Ohio

[73] Assignee: Atotech USA, Inc., Cleveland, Ohio

[21] Appl. No.: 562,393

[22] Filed: Nov. 24, 1995

[51] Int. Cl.[6] ..... C25D 3/30; C25D 7/06; C25D 3/60

[52] U.S. Cl. ..... 205/300; 205/140; 205/154; 205/252

[58] Field of Search ..... 205/50, 140, 154, 205/252, 300; 106/1.22, 1.25; 204/242

[56] References Cited

U.S. PATENT DOCUMENTS

| | | | |
|---|---|---|---|
| 2,372,032 | 3/1945 | Swalheim | 423/89 |
| 2,876,176 | 3/1959 | Pearson et al. | 205/140 |
| 2,931,759 | 4/1960 | Hill | 205/140 |
| 3,623,962 | 11/1971 | Beale | 205/101 |
| 3,907,653 | 9/1975 | Horn | 205/506 |
| 3,920,524 | 11/1975 | Rogers et al. | 205/140 |
| 4,006,213 | 2/1977 | Fisher et al. | 423/92 |
| 4,181,580 | 1/1980 | Kitayama et al. | 205/103 |
| 4,219,390 | 8/1980 | Stuart et al. | 205/99 |
| 4,432,844 | 2/1984 | Hinoda et al. | 205/101 |
| 4,508,480 | 4/1985 | Salm | 413/1 |
| 5,094,726 | 3/1992 | Nobel et al. | 205/254 |
| 5,304,297 | 4/1994 | Tench et al. | 205/101 |
| 5,312,539 | 5/1994 | Thomson | 205/101 |
| 5,378,347 | 1/1995 | Thomson et al. | 205/254 |

FOREIGN PATENT DOCUMENTS

| | | |
|---|---|---|
| 53-83937 | 7/1978 | Japan . |
| 56-96081 | 8/1981 | Japan . |
| 574485 | 10/1977 | U.S.S.R. . |

OTHER PUBLICATIONS

Srivastava et al., "Untersuchung der Zinn–Zink–Abscheidung aus einem Pyrophosphatbad" Metalloberfläche 30 (1976) (no month) 9 pp. 408–410 and English translation thereof: Investigation of the Tin/Zinc Deposit from a Pyrophosphate Bath.

*Primary Examiner*—Kathryn L. Gorgos
*Assistant Examiner*—Edna Wong
*Attorney, Agent, or Firm*—Finnegan, Henderson, Farabow, Garrett and Dunner, L.L.P.

[57] ABSTRACT

A composition of matter for electrolytically depositing a tin layer on an iron containing-substrate is disclosed comprising an acidic aqueous mixture of:

(a) a stannous tin halide; and (b) a salt having (1) an alkaline cation, and (2) an oxygen-containing inorganic acid anion reducible to a lower oxidation state.

The salt is selected to minimize oxidation of Sn (II) to Sn (IV). An electrolytic cell for electrolytically depositing a tin layer on an iron-containing substrate is also disclosed, where the cell has an electrolyte comprising the foregoing composition. The overall cell potential of the cell is decreased, and the free energy increased, compared to an electrolytic cell without the salt. A process is disclosed for depositing a tin layer on an iron containing substrate comprising electrolytically coating the substrate with the composition, or coating the substrate employing the foregoing electrolytic cell. A product made by any of the foregoing processes is also described.

26 Claims, No Drawings

HALOGEN TIN COMPOSITION AND ELECTROLYTIC PLATING PROCESS

BACKGROUND OF THE INVENTION

1. Field of Invention

The field of the invention is a tin oxidation inhibitor for an electrolytic tin halogen plating composition and a process for coating metallic substrates, such as an iron-containing substrate, employing the composition.

2. Description of Related Art

Electrolytic tin halogen plating compositions are employed for the continuous or semi-continuous electrolytic deposition of tin coatings on a steel strip. The composition is employed in an electrolytic cell and the strip passed through the cell. Stannous tin (Sn (II)) salts in the halide plating bath can be oxidized to stannic tin (Sn (IV)). The large surface of a strip line presents a large area of solution which will be available for air oxidation. The common 140° F. operating temperature enhances the activity of the solution and the loss of stannous tin by oxidation to stannic tin. Other oxidizing agents in the plating cell also account for this oxidation. Stannic tin forms metastannic acid, an insoluble tin compound that precipitates and forms sludge in the plating cell. As a result the plating process must be stopped periodically and the plating cell cleaned. The consequent lost production time translates into lost profits as does the loss of stannous tin.

Producers of tin can stock employ the halogen plating solution in large volumes. Production is oftentimes a continuous or round-the-clock operation performed on large strip plating machines and consumes tons of tin metal.

Halogen tin baths contain large amounts of chloride and fluoride ion in solution. These aggressive ions corrode the moving sheet steel before it can be coated with the inert tin, especially where only one side of the steel is plated during the first half of the plating cycle. This results in the very harmful, but unavoidable introduction of ferrous iron ion (Fe (II)) into the plating solution where the ferrous ion has a natural tendency to oxidize to the ferric ion (Fe(III)) by reacting with the air present at the large surface area. Iron in either oxidation state harms the bath.

Large amounts of ferrous iron can co-deposit with the tin. The resultant alloy will not reflow at low temperatures nor provide a corrosion resistant surface, which is essential for tin plated steel.

Producers know the importance of keeping ferric iron out of the bath because it reacts with stannous tin, oxidizing it to stannic tin while being reduced to ferrous iron. Ferric iron is the main cause of loss of stannous tin and the resultant production of metastannic acid sludge.

Introducing highly soluble sodium ferrocyanide into the plating solution provides ferrocyanide ions that react with the ferric iron and forms an insoluble blue material commonly known as Prussian Blue (ferric ferrocyanide). This removes ferric iron from the bath precipitating as a sludge at the bottom of the tank.

Mixing metastannic acid in the precipitate with the Prussian Blue creates not only a larger volume of waste, but also raises environmental concern because of the cyanide content in the sludge. It would therefore be an advantage to minimize or eliminate ferrocyanide materials from the bath.

As it is not feasible to totally eliminate the admittance of iron into the solution, it would be an advantage to remove the iron before conversion to the ferric form or prevent the formation of ferric ion by providing a reducing environment in the solution. The present invention provides this reducing environment.

The invention comprises a composition and process for treating a stannous tin (Sn(II)) halide plating bath to minimize, substantially minimize, or prevent the oxidation of the stannous tin to stannic tin (Sn(IV)).

Salm, U.S. Pat. No. 4,508,480, describes a composition and a process for producing tin plate by electrodeposition of a halogen-tin composition onto a continuous steel strip. The process includes steps of treating the steel strip by electrolytic cleaning, light pickling, electrolytic tinning, thermal reflowing of the deposited tin and a final chemical or electrochemical "passivation" treatment.

Thermal reflowing, also known as "flow-brightening," involves melting the plated tin coating by conduction, radiation or high frequency induction heating to a temperature slightly above the melting point of tin whereby tin flows to produce a smooth bright surface and a portion of the tin combines with the steel of the base strip to form an alloy layer.

Halogen-type electrolytic tinning involves a series of small cells which contain the electrolyte, each cell having its own circulation system, contact roll and anode bank. The process involves passing the steel strip horizontally across the upper surface of the electrolyte in a series of the cells so that the strip is plated only on the bottom side. This is followed by passing the strip upwardly and backwardly so that the original top of the strip becomes the bottom, and then passed across a further series of plating cells so that this bottom side also becomes electrolytically plated with tin. Halogen-type lines have the advantage of high strip speed operation and further, different coating weights can be applied to the opposite faces of the strip.

Typical baths comprise aqueous solutions of stannous tin chloride and fluoride ions as well as ferrocyanide ions to precipitate any ferric ion formed in the bath as a result of its contact with the steel substrate. Typical electrolyte solutions contain the following compositions:

1. Stannous Ions (Sn II) 12 to 25 grams per liter;
2. Chloride Ions 38 grams per liter;
3. Fluoride Ions 34 grams per liter; and
4. Ferrocyanide Ions 0.75 grams per liter.

The above materials may be varied anywhere from about ±10% to about ±40% and especially from about ±15% to about ±30%.

The coated strip is then rinsed in a fluoride ion containing rinsing solution such as an aqueous solution of sodium bifluoride and/or sodium fluoride. The rinsing solution preferably has a pH below about 4. Coating thicknesses anywhere from about 0.5 to about 1.5 g/m$^2$ are typically applied in this process.

Rogers, et al., U.S. Pat. No. 3,920,524, describes a similar process and particularly note that the substrate is passed through the electroplating solution at a rate of from about 90 to about 1,000 meters per minute where the potential applied is adjusted preferably from about 5 to about 25 volts with a current density being maintained at from about 0.2 to about 30 kiloamperes per square meter. Typical electroplating bath solution temperatures vary from about 45° C. to about 50° C.

Rogers, et al., further describe recirculating the electrolyte while moving the steel substrate through the electrolyte.

In one example, Rogers et al. describe the electrolytic deposition of tin onto a 100 cm wide carbon steel strip in a 1.5 meter deep tank using platinum-clad tantalum anodes. The example teaches circulating the electroplating solution in a 1.5 meter deep tank slightly wider than 100 cm at a rate of about 1135 liters per minute with the steel substrate travelling at a speed of about 90 to about 1000 meters per minute so as to vary the thickness of the electrodeposits from about 0.75 to about 3.0 micrometers. The electrolyte is maintained at a temperature of from about 45° to about 50° C. by appropriate heat exchange devices.

Application of a 20 volt potential across the assembly in the work piece provides a current density on the anode of about 4 kiloamperes per square decimeter to achieve a cathode current efficiency of from about 90 to about 97%.

Nobel, et al., U.S. Pat. No. 5,094,726, describes a similar halogen-tin electroplating process employing jet agitation or vigorous solution movement. Nobel, et al. specifically note that the industry achieves high speed plating by the use of high current densities and particularly high cathode efficiencies through the use of vigorous agitation and elevated solution temperatures.

Utilizing high speed agitation with the resultant rapid pumping action of the electrolyte and solution movement results in air mixed with the electrolyte promoting oxidation of Sn(II) to Sn(IV) and Fe(II) to Fe(III) where iron is pulled into the bath by the action of the electrolyte on the steel substrate. Both of these elements result in the production of sludge that reduces the efficiency of the bath and clogs or plugs the jets and spargers of the agitation system resulting in frequent and costly production shutdowns for cleanup and sludge removal. Sludge, however, can be minimized to some degree by reducing agents such as pyrocatechol, resorcinol, or hydroquinone. Nobel, et al. employs various imidazolines to minimize sludge formation.

The related art describes various methods of sludge removal, such as Fisher, et al., U.S. Pat. No. 4,006,213, describing methods for recovering hydrated stannic oxide and alkaline metal ferrocyanide whereas Thompson, et al., U.S. Pat. No. 5,378,347, incorporates various antioxidants into the halogen tin bath, such as a Group IV B, V B, or VI B elements from the periodic table of elements.

Typical tin baths employed by Thompson, et al. include:

1. stannous chloride 75 g/l;
2. sodium fluoride 30 g/l;
3. sodium bifluoride 45 g/l;
4. sodium chloride 50 g/l; and
5. pH 3.2–3.6.

Although not stated by Thompson et al, it is typical in the art to vary the composition of the foregoing bath anywhere from ± about 10% to ± about 40%, especially ± about 15% to ± about 30%.

Beale, U.S. Pat. No. 3,623,962, minimizes sludge formation by the continuous deaeration of a halogen-tin electrolyte to remove gases absorbed when the electrolyte is exposed to ambient atmosphere, thereby decreasing the opportunity of the electrolyte to absorb oxygen.

Stuart, et al., U.S. Pat. No. 4,219,390, describes a method for regenerating an electrolytic tinning bath in which the bath is freed from ions of foreign metal introduced during tinning, by detinning the bath electrolytically and removing the foreign metal ions by means of a cation exchanger.

Horn, U.S. Pat. No. 3,907,653, treats the sludge of a halogen tin plating bath containing both sodium fluorostannate and iron ferrocyanide by forming various solutions and complexes followed by precipitating the various components.

Swalheim, U.S. Pat. No. 2,372,032, notes that ordinarily the removal of fluorostannate sludge presents no difficulty when settled out or filtered out of the plating bath, but the recovery of the tin content of the sodium fluorostannate bath presented a difficult problem. Swalheim describes treating a halogen-tin plating bath sludge by converting an alkali fluorostannate to stannous fluoride and an alkali fluoride by effecting contact of the fluorostannate with molten tin, preferably in the presence of residual stannous fluoride.

SUMMARY OF THE INVENTION

The present invention comprises a composition and process which substantially or completely obviates one or more of the limitations and disadvantages described in the related art.

Additional features and advantages of the invention will be set forth in the description which follows, and in part will be apparent from the description or may be learned by practice of the invention. The objectives and other advantages of the invention will be realized and attained by the composition and process particularly pointed out in the written description and claims hereof.

In one embodiment, the invention comprises a composition of matter for electrolytically depositing a tin layer on an iron-containing substrate comprising an acidic aqueous mixture of:

(a) a stannous tin halide; and (b) a salt having (1) an alkaline cation, and (2) an oxygen-containing inorganic acid anion reducible to a lower oxidation state.

In a further embodiment, the salt is selected to minimize oxidation of Sn (II) to Sn (IV), especially when Fe III ions or other ions reducible by Sn II are present.

In another embodiment, the invention also comprises a process for depositing a tin layer on an iron-containing substrate comprising electrolytically coating the substrate with the composition of the invention.

The invention in a further embodiment comprises an electrolytic cell for electrolytically depositing a tin layer on an iron-containing substrate where the cell has an electrolyte comprising an acidic aqueous mixture of compounds that undergo a redox reaction. The compounds comprise:

(a) a stannous tin halide;

(b) a ferric iron salt;

(c) a salt having (1) an alkaline cation, and (2) an oxygen-containing inorganic acid anion reducible to a lower oxidation state;

where the salt is selected so that when the compounds undergo the redox reactions:

(A) Sn (II) oxidized to Sn (IV);

(B) Fe (III) reduced to Fe (II); and (C) the inorganic acid anion reduced to a lower oxidation state;

the overall cell potential of the cell is decreased, and the free energy increased, compared to an electrolytic cell lacking the salt and having electrolyte compounds undergoing the redox reactions:

(D) Sn (II) oxidized to Sn (IV); and (E) Fe (III) reduced to Fe (II).

In another embodiment, a process is provided for coating a steel strip employing the foregoing electrolytic cell.

In a further embodiment, the invention comprises a product made by any of the foregoing processes.

The invention provides an advantage over the prior art for several reasons. First, previous attempts to prevent the oxidation of stannous ion used a classical antioxidant which is a form of hydroquinone. This class of compounds is an environmental liability. Secondly, the material is easily controlled by rather simple laboratory instrumentation.

Thirdly, the salt also shows an ability for reducing the ferric iron to ferrous iron and thereby minimizing, substantially eliminating, or eliminating the oxidation of stannous tin to stannic tin.

Tin platers employing the halogen tin plating process will realize the commercial significance of the present invention. Reduction of sludge from oxidized stannous ion provides a savings in both the cost of making up new solution and waste disposal. Less downtime for tank maintenance means increased production.

The tin layer may comprise an adherent tin coating on the iron-containing substrate at the interface of the tin and the iron-containing substrate, and preferably comprises a layer that is sufficiently adherent so as to be usable in the production of tin plated steel stock used in the manufacture of food containers. The tin layer can be applied in an amount anywhere from about 0.5 to about 15 $g/m^2$, especially from about 0.5 to about 3 $g/m^2$ and preferably from about 0.5 to about 1.5 $g/m^2$. Alternatively, the thickness of the tin layer applied to the iron-containing substrate may be anywhere from about 0.8 to about 6 micrometers, especially from about 0.2 to about 5 micrometers and preferably from about 0.75 to about 3.0 micrometers.

The iron-containing substrate preferably comprises a steel substrate such as that employed in the manufacture of tin plated steel for the fabrication of containers although iron alloys may be employed such as alloys of iron that contain other Group VIII elements of the Periodic Table of Elements, and in some instances are Group IVB, VB, VIB, or VIIB elements as well. Any combination of alloying elements may be used in this regard especially about 2 to about 4 alloying elements.

The stannous tin halide employed according to the invention can comprise any fluoride, chloride, bromide or iodide of tin, but especially those stannous tin halides that are well known and utilized in halogen tin electrolyte compositions. Stannous chloride and stannous fluoride are especially suitable in this regard. Various mixtures of tin halides may be employed such as the mixtures containing from 2 to about 3 different stannous halides.

The halogen tin coating baths also contain halides salts comprising an alkaline cation and a halogen anion as those terms are defined herein. Alkali halides and alkaline earth halides are preferred but especially alkali metal halides, preferably fluoride salts or chloride salts and mixtures thereof. Any mixture of salts may be employed including the two component, three component, or four component mixtures. Examples of the salts include sodium, potassium and lithium halides, especially the chlorides or fluorides as well as the acid salts such as sodium bifluoride and the like. Additionally, fluroboric acid may also be employed as well as the salts thereof.

In the process of the invention, the iron-containing substrate such as a steel strip is coated so that the composition and steel strip are moving with respect to one another, by which it is intended to mean that the steel strip is stationery and the composition is moving or the steel strip is moved through the composition which is neither agitated nor stirred nor forced against the steel strip by any additional means. Lastly, both the composition and the steel substrate are moving where the composition is moved by additional means such as stirring means or pumping means and the steel strip is moving, whether the composition and the steel strip are moving cocurrently or countercurrently with respect to one another.

As noted, the composition of the invention also includes a salt of an alkaline cation and an oxygen-containing inorganic acid anion reducible to a lower oxidation state. The alkaline cation in this regard comprises any Group IA or Group IIA alkali metal, but especially the lithium, sodium, or potassium cations of Group IA and the calcium, strontium or barium cations of Group IIIA of the Periodic Table of Elements.

In addition, the alkaline cation can comprise ammonia, hydroxyl amine or the various organic amines known in the art.

The various oxygen-containing inorganic acid anions reducible to a lower oxidation state generally comprise the oxygen acids based on nitrogen, phosphorous and sulfur, especially those acids described in *Hackh's Chemical Dictionary*, Third Edition, incorporated herein by reference. These acids are described in this reference under the entries nitrogen, phosphorous and sulfur and include pyrophosphates, metaphosphates, phosphates, (all of which are based on pentavalent phosphorous); hypophosphates (based on tetravalent phosphorous); and metaphosphites and phosphites, (based on trivalent phosphorous). The anions based on sulfur include sulfonates and sulfates (based on hexavalent sulfur); and where reducible, sulfoxylic acid i.e., $S(OH)_2$ (based on divalent sulfur); and anions classified as sulfinites and sulfites (based on tetravalent sulfur).

The nitrates are especially preferred salts.

The range of operation is between about 20 and about 500 ppm of salt on a molar basis and based on the tin in the bath composition.

The nitrite anion does not appear to benefit this system. By itself, the transformation of nitrate to nitrite is a reduction. It will, therefore, oxidize a second susceptible species in the bath. This would contradict the objective of the invention. Although not wishing to be limited by any theory, the inventors believe that when the nitrate is reduced to nitrite, an oxygen radical is released so that it can form hydrogen peroxide with an available water molecule. It may form a complex with the nitrite and water to effectively become a reducing agent in the system.

The inventors believe one possible nonlimiting explanation or theory for the success of the invention is the seemingly opposite effect that peroxide anions have in solution. The art recognizes that hydrogen peroxide at low pH does not function as an oxidizer, but rather a reducing agent. According to this theory the in situ production of low levels of hydrogen peroxide/nitrite species will serve as a reducing agent that will keep the ferric ion reduced to the ferrous form.

A more rigorous thermodynamic explanation of the mechanism is given as follows from standard electrochemical half cell reactions:

$$Fe^{+3}+e^{-1}\rightarrow Fe^{+2}\ E_o=+0.77\ V$$

$$Sn^{+2}\rightarrow Sn^{+4}+2e^{-1}\ E_o=+0.13\ V$$

The overall cell potential is +0.90 V. The reaction can proceed. The free energy of formation for the two reactions in a cell, is −174 kJ. This indicates that the formation of stannic ion is spontaneous.

The plating solution must have a reducing agent to minimize ferric concentration or have a chemical component in the system which will change the overall standard potential of the cell. Since nitrate is not normally used as a reducing agent, the following can be written:

$$NO_3^{-1}+3H^{+}+2e^{-}\rightarrow HNO_2+H_2O\ E_o=-0.93\ V$$

The nitrate ion is reduced to nitrous acid. The addition of nitrate changes the overall cell potential to 0.030 V and the free energy to +5.79 kJ. The positive free energy indicates that the oxidation of stannous ion to stannic ion is not spontaneous in the presence of nitrate ion.

The exact mechanism will depend on the equilibrium between nitric acid and nitrous acid. The nitrous acid formed "in situ" is apparently the reducing agent which maintains the iron in the bath in the ferrous form. To complete the system, the nitric acid is regenerated according to the following:

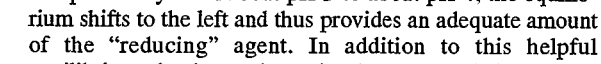

$$3HNO_2 \longleftrightarrow NO_3^- + 2NO + H^+ + H_2O$$

Since the bath is run at an acidic pH, or from about pH 0.3 to about pH 6.3, especially from about pH 2 to about pH 5, and preferably from about pH 3 to about pH 4, the equilibrium shifts to the left and thus provides an adequate amount of the "reducing" agent. In addition to this helpful equilibrium, the thermodynamics demonstrated above show that the free energy of the system is inadequate to favor oxidation of the stannous to stannic form of tin.

The aqueous mixture of the stannous tin halide and the salt having an alkaline cation and an oxygen-containing inorganic acid anion reducible to a lower oxidation state includes aqueous suspensions, dispersions especially colloidal dispersions and solutions of the stannous tin halide and the salt in water. Solutions are especially preferred.

The various halogen tin compositions that may be employed are substantially the same as those described by Salm, U.S. Pat. No. 4,508,480, as described herein with the exception that the ferrocyanide material is optionally employed. The halogen tin bath of Thompson et al., U.S. Pat. No. 5,378,347, as described herein can also be employed, with the exception that the antioxidants employed by Thompson et al. and other antioxidants, as well as art known additives (e.g. those noted in the references cited herein) are optionally utilized. Both of the foregoing baths include the salt having an alkaline cation and an oxygen-containing inorganic acid anion reducible to a lower oxidation state in the amounts described herein, and are maintained at the pH described herein.

Additionally, the composition of the present invention can be used to plate an iron-containing substrate such as the steel substrates described by Salm, U.S. Pat. No. 4,508,480, Rogers et al., U.S. Pat. No. 3,920,524, Nobel et al., U.S. Pat. No. 5,094,726 and Thompson et al., U.S. Pat. No. 5,378,347, using the various electrolytic plating conditions described in these patents, all of which are incorporated herein by reference.

The following examples are illustrative.

EXAMPLE 1

The following halogen tin aqueous solution is prepared:

| | |
|---|---|
| $SnCl_2$ | 17 g/l (10 g/l (Sn)II). |
| NaCl | 23 g/l |
| $NaHF_2$ | 34 g/l |

In three controlled oxidation test, the foregoing solution has $Fe^{+2}$ added to it in an amount of 0.85 g/l; along with 250 ppm; 1000 ppm and 3000 ppm $NaNO_3$.

Air is bubbled through each of the three samples at room temperature for a period of 24 hours and the solutions are then analyzed for Sn(II) ions. The results obtained are compared to a solution that similarly had air passed through it but without the addition of the nitrate salt.

When the nitrate salt is added to the solutions, the amount of Sn(II) ion retained is 84%. The control (with no nitrate) has retained only 30% of the initial stannous charge.

EXAMPLE 2

The above solutions containing the nitrate salt are also evaluated in an electrolytic cell about 90 cm in diameter and 40 cm in depth with a rotating steel cathode having a surface area of about 15 $cm^2$ rotating at a speed of about 1500 rpm, and at a voltage of about 3 volts, a current density of about 4000 amperes/$m^2$ for a period of time of about 4–5 seconds.

After plating with each composition, the surface of the cathode is examined through an eye loupe to determine abnormal crystal development as evidenced by the formation of "trees." The coating is then subjected to a "rub off" test to evaluate the tin coated surface for adhesion. It is the object of this test to determine whether or not the foregoing plating solutions containing the nitrate salt produce a dense fine grain coating with good adhesion and normal crystal development. These coatings with the nitrate salt did in fact produce these results.

EXAMPLE 3

Mandrels are plated from the standard halogen solution of Example 1 with 100 ppm of the nitrate compound ($NaNO_3$) in the current density range of 2 to 3 Amps/sq. in.

A dense fine grain coating with good adhesion and normal crystal development is obtained.

EXAMPLE 4

Example 3 is repeated with 500 ppm of nitrate and substantially the same results obtained.

EXAMPLE 5

Example 3 is repeated but with 100 ppm $Fe^{+2}$ and substantially the same results obtained.

EXAMPLE 6

Example 4 is repeated but with 100 ppm $Fe^{+2}$ and substantially the same results obtained.

EXAMPLE 7

Mandrels are plated from the standard active halogen tin solution of Example 1 with 3–4 g/l sodium ferrocyanide (Tin Mill solution) with 100 ppm of $NaNO_3$ at a current density of from about 2 to about 3 Amps/sq.in. Good tin plating is obtained on the substrate.

EXAMPLE 8

Example 7 is repeated but with 500 ppm of $NaNO_3$ and substantially the same results obtained.

It will be apparent to those skilled in the art that modifications and variations can be made in the novel tin halogen composition of matter and process for coating an iron-containing substrate as described in the present invention without departing from the spirit or scope of the invention. It is intended that these modifications and variations and their equivalents are to be included as part of this invention, provided they come within the scope of the appended claims.

What is claimed is:

1. A composition of matter for electrolytically depositing a tin layer on an iron-containing substrate comprising an acidic aqueous mixture of:

(1) a stannous tin halide; and (2) a salt having (a) an alkaline cation, and (b) an oxygen-containing inorganic nitrogen or sulfur acid anion reducible to a lower oxidation state.

2. The composition of claim 1, where said oxygen-containing inorganic acid anion comprises a nitrogen acid anion.

3. The composition of claim 2, where said nitrogen acid anion comprises a nitric acid anion.

4. The composition of claim 2, where said alkaline cation comprises an alkaline earth metal, an alkali metal or ammonium cation.

5. The composition of claim 2, further comprising a water soluble composition wherein said alkaline cation comprises an alkali metal cation.

6. The composition of claim 1, further comprising a water soluble composition wherein said salt comprises an alkali metal nitrate.

7. The composition of claim 1 where said salt is selected to minimize oxidation of Sn (II) to Sn (IV).

8. The composition of claim 1, where said salt produces hydrogen peroxide in situ in said composition when reduced to a lower oxidation state.

9. A process for depositing a tin layer on an iron-containing substrate comprising electrolytically coating said substrate in an acidic aqueous mixture of:

(a) a stannous tin halide; and (b) a salt having (1) an alkaline cation, and (2) an oxygen-containing inorganic nitrogen or sulfur acid anion reducible to a lower oxidation state.

10. The process of claim 9, where said oxygen-containing inorganic acid anion comprises a nitrogen acid anion.

11. The process of claim 10, where said nitrogen acid anion comprises a nitric acid anion.

12. The process of claim 10, where said alkaline cation comprises an alkaline earth metal, an alkali metal or ammonium cation.

13. The process of claim 10, further comprising a water soluble composition wherein said alkaline cation comprises an alkali metal cation.

14. The process of claim 13, where said iron-containing substrate comprises a steel substrate.

15. The process of claim 9, further comprising a water soluble composition wherein said salt comprises an alkali metal nitrate.

16. The process of claim 15, where said iron-containing substrate comprises a steel strip and said aqueous mixture and steel strip are moving with respect to one another.

17. The process of claim 9 wherein said aqueous acidic mixture contains Fe III ions and said salt is selected to minimize oxidation of Sn (II) to Sn (IV).

18. The process of claim 9 where said salt produces hydrogen peroxide in situ in said composition when reduced to a lower oxidation state.

19. A process for depositing a tin layer on an iron-containing substrate, comprising electrolytically coating said substrate in an electrolyte comprising an acidic aqueous mixture of compounds that undergo a redox reaction, said compounds comprising:

(a) a stannous tin halide;

(b) a ferric iron salt;

(c) a salt having (1) an alkaline cation, and (2) an oxygen-containing inorganic nitrogen or sulfur acid anion reducible to a lower oxidation state;

said salt being selected so that when said compounds undergo the redox reactions:

(A) Sn (II) oxidized to Sn (IV);

(B) Fe (III) reduced to Fe (II); and (C) said inorganic acid anion reduced to a lower oxidation state;

the overall potential of said coating process is decreased, and its free energy increased, compared to a coating process lacking said salt and employing electrolyte compounds undergoing the redox reactions:

(D) Sn (II) oxidized to Sn (IV); and (E) Fe (III) reduced to Fe (II).

20. The process of claim 19, where said oxygen-containing inorganic acid anion comprises a nitrogen acid anion.

21. The process of claim 20, where said nitrogen acid anion comprises a nitric acid anion.

22. The process of claim 20, where said alkaline cation comprises an alkaline earth metal, an alkali metal or ammonium cation.

23. The process of claim 20, further comprising a water soluble electrolyte wherein said alkaline cation comprises an alkali metal cation.

24. The process of claim 23, where said iron-containing substrate comprises a steel substrate.

25. The process of claim 19, further comprising a water soluble electrolyte wherein said salt comprises an alkali metal nitrate.

26. The process of claim 25 where said iron-containing substrate comprises a steel strip and said strip and said aqueous mixture are moving with respect to one another.

* * * * *